US005498112A

United States Patent [19]

Schwettmann et al.

[11] Patent Number: 5,498,112

[45] Date of Patent: Mar. 12, 1996

[54] METHOD OF AND APPARATUS FOR APPLYING PROTECTIVE JACKETS TO BOOKS

[75] Inventors: Dietmar Schwettmann, Rahden; Siemen Garlichs, Espelkamp, both of Germany

[73] Assignee: Kolbus GmbH & Co. KG, Rahden, Germany

[21] Appl. No.: 88,812

[22] Filed: Jul. 8, 1993

[30] Foreign Application Priority Data

Oct. 31, 1992 [DE] Germany ..... 9214801 U

[51] Int. Cl.[6] ..... B42C 11/00

[52] U.S. Cl. ..... 412/1; 412/9; 412/19; 412/24

[58] Field of Search ..... 412/1, 3, 4, 5, 412/6, 8, 9, 19, 22, 24, 902

[56] References Cited

U.S. PATENT DOCUMENTS 4,556,353 12/1985 Ehlermann ..... 412/19 X
4,662,979 5/1987 Kupka et al. ..... 412/19 X
5,174,705 12/1992 Detterman et al. ..... 412/1

FOREIGN PATENT DOCUMENTS 0158493 10/1985 European Pat. Off. ..... 412/1

*Primary Examiner*—Willmon Fridie, Jr.
*Attorney, Agent, or Firm*—Chilton, Alix & Van Kirk

[57] ABSTRACT

The application of protective jackets comprised of paper to a book is facilitated by minimizing bending stresses in the jacket paper in the fold areas where the jacket is wrapped around the opposed longitudinal edges of the book cover in the course of defining jacket retention flaps. The stresses are relieved by the metered, uniform moistening of the fold areas of the jacket to thereby diminish the flexual strength of the paper fibers in these areas.

12 Claims, 1 Drawing Sheet

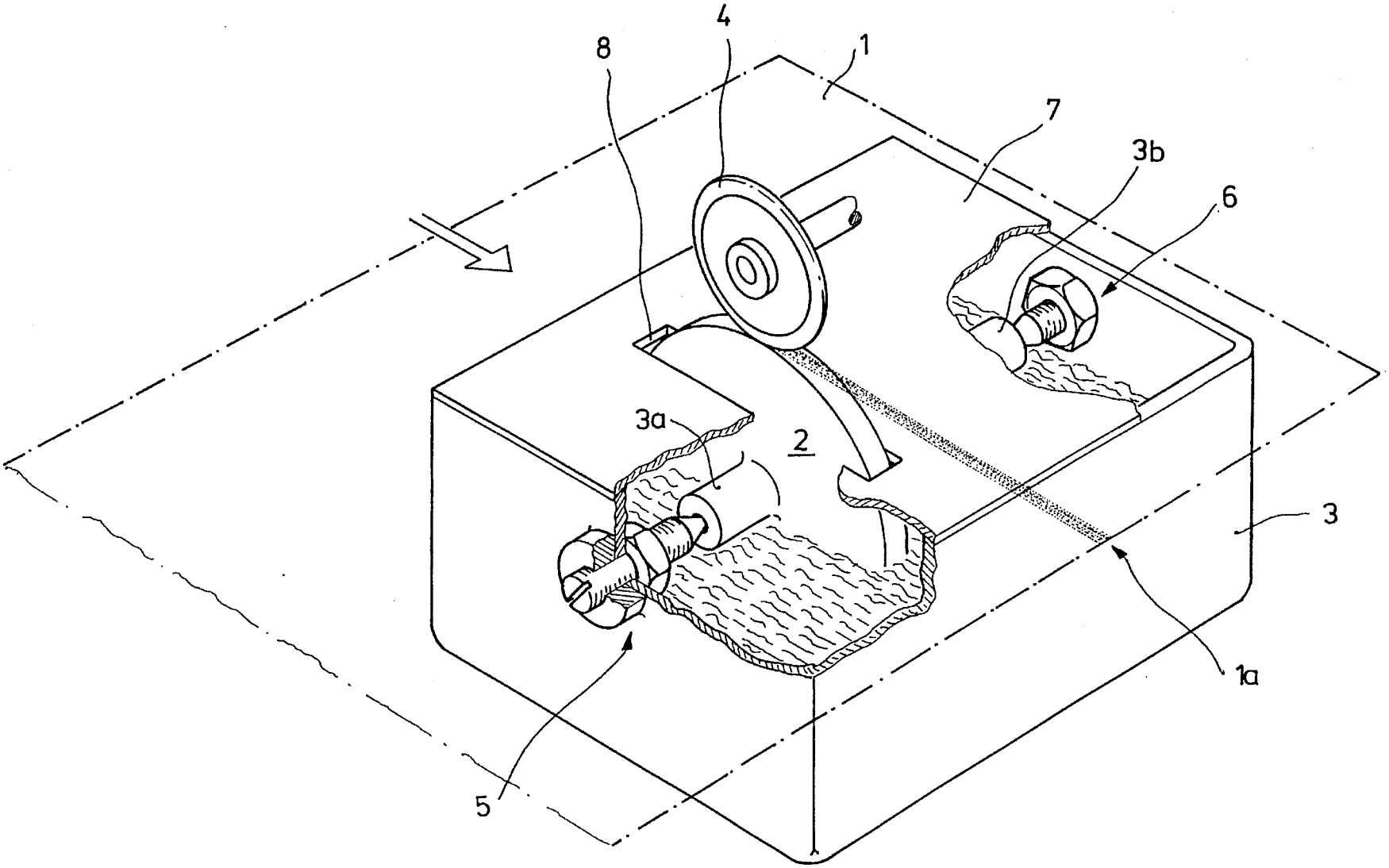
1
2
3
3a
3b
4
5
6
7
8
1a

METHOD OF AND APPARATUS FOR APPLYING PROTECTIVE JACKETS TO BOOKS

BACKGROUND OF THE INVENTION

1. Field of the Invention

The present invention relates to the application of so-called dust jackets to books and particularly to the pre-treatment of unfolded protective paper jackets in the interest of insuring the proper fitting thereof to book covers. More specifically, this invention is directed to apparatus which facilitates the mechanized application of a paper jacket to a book cover and especially to apparatus for performing a conditioning apparatus on an unfolded jacket prior to folding the projecting side portions thereof around the longitudinal edges of an opened cover of a book. Accordingly, the general objects of the present invention are to provide novel and improved methods and apparatus of such character.

2. Description of the Prior Art

Methods and apparatus for the application of dust jackets to books are well known in the art. Thus, by way of example, published German application P 11 03 294 discloses an apparatus in which books, with the spines facing downwardly, are positioned upon unfolded jackets. The book covers are then opened outwardly from the book block at an angle which will be in the range between 55 and 57.5 degrees. The projecting side edge portions of the jackets are thereafter folded around the longitudinal edges of the opened cover to form flaps and the books are reclosed thus capturing the jackets in the desired position where they are wrapped around the books. Tight wrapping of the jackets around the books is, of course, desired. However, tight wrapping is resisted by the stiffness of the jacket material and, accordingly, jacket application methods and apparatus of the type shown in the referenced German application do not provide satisfactory results. Restated, as a consequence of the recovery force exerted by the jacket material, it is frequently impossible to avoid having the covers of the book reopen and slip out of the flaps which are formed in the jacket during folding thereof. Any such separation of the book cover from the jacket flap must be corrected by hand and such correction is a labor intensive and thus expensive operation. It is to be noted that the liklihood of a book cover reopening after jacket application increases if the jacket material is relatively thick or if the jacket material has a coating.

The book making industry has long sought a satisfactory method of applying jackets to book covers, i.e., a method which will ensure a high quality product. Poorly fitting jackets result in books having an unsightly appearance. Additionally, poorly fitting jackets significantly interfere with subsequent processing operations such as, for example, individual packaging of the jacketed books in a shrink film. Further, and most importantly, poorly fitting jackets have a tendency to interfere with the handling of a book by the end user.

To further discuss prior art efforts to apply jackets to book covers, it has long been known that the distance between the oppositely disposed front edges of a book cover, measured around the book spine, is greater when the book is closed than when the book covers have been opened outwardly. Accordingly, the folding of a jacket around the edges of a book cover which is held at a relatively large opening angle necessarily leads to excessively tight fitting of the jacket. A excessively tight fit of the jacket increases the liklihood of cover reopening and separation of the book cover from the jacket fold.

It is to be noted that, in an effort to avoid the above-discussed problems associated with the reopening of the book covers as a consequence of the recovery forces exerted by jacket materials, the above-referenced German application suggests that the jacket be creased or scored prior to folding around the cover. Such creasing or scoring will reduce the recovery forces exerted by the inwardly folded material. However, creasing or scoring does not exclude the possibility that the creases will slip over the edge of the cover or that the jacket will not be wrapped sufficiently tightly around the book. Such slippage or a failure to achieve tight wrapping are inherent possibilities due to the existence of unavoidable manufacturing tolerances. Restated, it is not always possible for there to be dimensional coincidence between the inter-crease length and the setting of the creasing elements. Further, and this is particularly true in the case of coated jackets, the step of forming creases invariably results in the surface of the jacket cracking and such cracks result in an unsightly, and thus unacceptable, appearance.

Another example of a prior art technique for wrapping protective jackets around books may be seen from German Patent 26 20 047. The technique of this German patent involves wrapping an unfolded jacket around a book cover that has been swung outwardly, i.e., away from the book block. The wrapped cover is then folded around the opposite longitudinal edges of the book cover to form the retention flaps and the book is thereafter reclosed. In the technique of this German patent, the book covers are swung away from the book block, i.e., are opened to an angle of approximately 30°, and heat is applied during the folding operation. While the desired tight fitting of the jackets can be achieved by the application of heat during the folding operation, the technique of German Patent 26 20 047 does not eliminate the above-discussed problem of separation of the book cover from the jacket fold.

SUMMARY OF THE INVENTION

The present invention overcomes the above-briefly discussed and other deficiencies and disadvantages of the prior art by providing a novel technique for pre-conditioning protective jackets prior to the application thereof to a book cover. The invention also encompasses apparatus for implementing this novel method in an uncomplicated and reliable manner whereby the quality of the jacketed books which are produced is increased as a result of secure fitting of the jackets to the books.

The objects of the present invention are achieved by applying, to the fold areas of a jacket, a liquid drawn from a reservoir. In accordance with the preferred embodiment, the liquid is water to which a wetting agent has been added. The liquid is preferably applied to the jacket by means of applicator discs which function as one roller of a pair of pinch rollers between which the jacket paper is caused to pass. The wetting of the jacket in the fold areas relieves the bending stress in the jacket paper.

BRIEF DESCRIPTION OF THE DRAWING

The present invention may be better understood and its numerous objects and advantages will become apparent to those skilled in the art by reference to the accompanying drawing which is a perspective view, partly broken away to reveal detail, of one of a pair of bending stress relieving devices which may be employed in the practice of the invention.

DESCRIPTION OF THE DISCLOSED EMBODIMENT

With reference to the drawing, one of a pair of novel devices which will be employed with a state-of-the-art jacketing machine has been shown in a perspective view, partly broken away to reveal detail. A jacketing machine of the type with which the present invention will be associated includes means for bringing together the books to be jacketed, with their spines facing upwardly, and the flat sheets which are to be mated with the books and folded to define the jackets. The jacketing machine thus includes a conveyor system for serially delivering the unfolded jackets to a station where the books are positioned thereon, followed by apparatus for opening the book covers, wrapping the jackets around the opened covers, folding the projecting side portions of the jacket about the opposed longitudinal edges of the book covers to define retention flaps, and closing the books to capture the covers.

In accordance with the invention, in order to reduce the bending stresses which are created in the jacket paper during the forming of the flaps, moisture is applied to the fold areas of the jacket. In the drawing, a portion of a jacket is indicated at 1 while one of the fold areas is indicated at 1*a*. In accordance with the preferred embodiment, the applied moisture is water which has been treated by the mixing of a wetting agent therewith. It will be understood that there will be a second apparatus, identical to the device shown in FIG. 1, which cooperates with the moving jacket, the second device being located to the left of the device located in FIG. 1 and the two devices having coplanar work regions. The jackets pass through the apparatus in the direction indicated by the arrow.

The apparatus of FIG. 1 comprises a reservoir 3 which contains the liquid substance to be applied, e.g., water treated by mixture with a wetting agent. A rotatable applicator disc 2 is mounted so as to extend into reservoir 3. During rotation, disc 2 will pick up, and carry on its circumferential surface, the treated water. The disc 2 will thus supply the treated water to the defined fold area 1*a* of the jacket 1 from below at a constant, metered rate.

To guard against contamination of the liquid in reservoir 3, the reservoir is provided with a cover 7 having a aperture 8. The applicator disc 2 extends through the aperture 8 with a small clearance thus minimizing the possibility of debris and other contaminants passing into the reservoir.

In accordance with the preferred embodiment, the applicator disc 2 is supported so that it can rotate freely. For this purpose, axially adjustable point bearings, indicated generally at 5 and 6, are provided in the side walls of the reservoir. The disc 2 is provided with a pair of bearing axles 3*a* and 3*b* which are respectivey engaged by bearings 5 and 6.

Also in accordance with the preferred embodiment, rotation is imparted to the applicator disc 2 by the jacket 1 itself. The jacket is urged against the surface of applicator disc 2 by means of a counter roller 4 which is also mounted for free rotation.

The applicator disc 2 guarantees metered, uniform moistening of defined fold areas of the jacket. The applied moisture causes the paper fibers of the jacket to swell, and thus neutralizes the flexural strength of the fibers in the wetted areas of the jacket. In conjunction with heat energy supplied during the subsequent folding operation, the moisture is extracted from the fold area with the result that the side portions of the jacket will remain fixed in their prescribed, turned-over positions, i.e., the flaps formed during the folding operation remain closed. In the practice of the present invention, a creasing or scoring operation prior to fitting the jackets to the book need not be employed, even when stiff jacket materials or thick book covers are involved.

The above-described apparatus is of uncomplicated construction and thus is inexpensive to manufacture. Furthermore, the apparatus is characterized by a high degree of reliability and by the need for only minimal maintenance.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An apparatus for wrapping protective jackets around books, the jackets comprising fibrous sheet material and being supplied to the apparatus via a sheet conveyor, the jacket sheets having projecting side portions which are to be folded around the longitudinal edge of the covers of a book after the covers have been at least partly opened away from the book block, the book being closed after the folding of the jacket sheet to define jacket retention flaps disposed on the inside of the covers, the improvement comprising:

a reservoir containing a liquid which will interact with the fibers comprising the jacket sheet to reduce the flexural strength thereof; and an applicator disc which extends partly into said reservoir, said applicator disc intersecting the path of movement of jacket sheets being conveyed to the wrapping apparatus and contacting a first side of the jacket sheet in a defined fold area.

2. The apparatus of claim 1 wherein said reservoir contains a mixture of water and a wetting agent.

3. The apparatus of claim 1 wherein said applicator disc is mounted for free rotation and is caused to rotate by the engagement thereof with the moving jacket sheet.

4. The apparatus of claim 2 wherein said applicator disc is mounted for free rotation and is caused to rotate by the engagement thereof with the moving jacket sheet.

5. The apparatus of claim 1 further comprising:

a pressure roller positioned oppositely from and in alignment with said applicator disc, the jacket sheet passing between said pressure roller and said applicator disc whereby the jacket sheet is held against the applicator disc by said pressure roller.

6. The apparatus of claim 5 wherein said pressure roller is mounted for free rotation.

7. The apparatus of claim 3 further comprising:

a pressure roller positioned oppositely from and in alignment with said applicator disc, the jacket sheet passing between said pressure roller and said applicator disc whereby the jacket sheet is held against the applicator disc by said pressure roller.

8. The apparatus of claim 4 further comprising:

a pressure roller positioned oppositely from and in alignment with said applicator disc, the jacket sheet passing between said pressure roller and said applicator disc whereby the jacket sheet is held against the applicator disc by said pressure roller.

9. The apparatus of claim 8 wherein said pressure roller is mounted for free rotation.

10. In a method of applying protective jackets to books, the books having covers and the jackets being formed from flat sheets of fibrous material, the jacket sheets having projecting side regions which are folded around the opposed longitudinal edges of the book cover to define jacket retention flaps, the improvement comprising:

forming a mixture of water and a wetting agent in a reservoir; and withdrawing the mixture from the reservoir and applying the same to one side of the jacket sheet in narrow bands which correspond to the regions where the jacket sheet is to be folded.

11. The method of claim 10 wherein the step of withdrawing comprises:

causing the jacket blank to pass between a pressure roller and a rotating applicator disc which extends into the reservoir.

12. The method of claim 11 wherein rotation of the applicator disc to cause wetting of the circumferential surface thereof is caused by contact with the jacket sheet.

* * * * *